United States Patent [19]

Sepaniac

[11] 4,073,491

[45] Feb. 14, 1978

[54] TENNIS NET

[75] Inventor: Walter J. Sepaniac, Philadelphia, Pa.

[73] Assignee: The Raymond Lee Organization, Inc., New York, N.Y.

[21] Appl. No.: 675,728

[22] Filed: Apr. 12, 1976

[51] Int. Cl.[2] ..... A63B 61/00

[52] U.S. Cl. ..... 273/29 B

[58] Field of Search ..... 273/26 A, 29 B, 29 BA, 273/185 A, 102 B; D25/45; 49/9, 34; 160/351, 327, 354, 368

[56] References Cited

U.S. PATENT DOCUMENTS

| | | | |
|---|---|---|---|
| 401,082 | 4/1889 | Taylor | 273/29 B |
| 2,052,637 | 9/1936 | Lichtenstein | 273/29 B |
| 2,491,707 | 12/1949 | Boyden | 160/351 |
| 3,072,410 | 1/1963 | Simjian | 273/185 A |
| 3,649,011 | 3/1972 | Barnes | 273/29 B |
| 3,689,067 | 9/1972 | Brimley | 273/29 B |

*Primary Examiner*—Richard C. Pinkham
*Assistant Examiner*—T. Brown
*Attorney, Agent, or Firm*—Howard I. Podell

[57] ABSTRACT

A tennis net designed to permit balls striking the net to pass through the net for ready retrieval. The net is formed of a pair of spaced horizontal tension members, each covered by a fabric strip to which the loops of a continuous length of flexible net cord are fastened so as to orient the flexible net cord perpendicular to the spaced tension members which support the flexible cord as a series of spaced parallel vertical members. The flexible cord may readily separate when struck by a tennis ball to permit the ball to pass through the net, while indicating by their action and the impedance to the ball, that the ball is out of play.

2 Claims, 4 Drawing Figures

TENNIS NET

SUMMARY OF THE INVENTION

My invention is a tennis net designed to permit balls striking the net to pass through the net for ready retrieval. The net is formed of a pair of spaced horizontal tension members, each covered by a fabric strip to which the loops of a continuous length of flexible net cord are fastened so as to orient the flexible net cord perpendicular to the spaced tension members which support the flexible cord as a series of spaced parallel vertical members. The flexible cord may readily separate when struck by a tennis ball to permit the ball to pass through the net, while indicating by their action and the impedance to the ball, that the ball is out of play.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
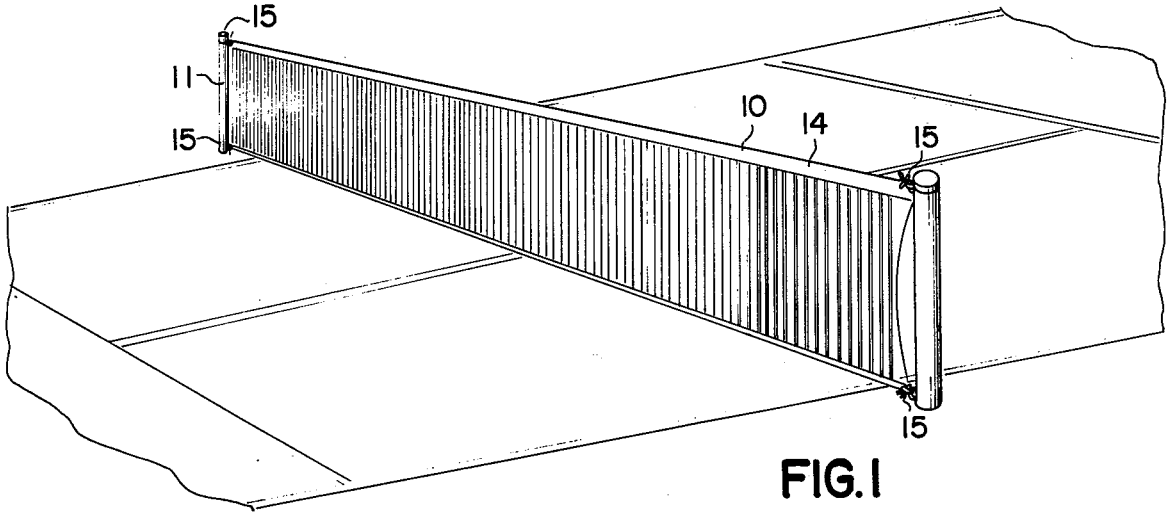
FIG. 1 is a perspective view of the invention in use.
Figure 2:
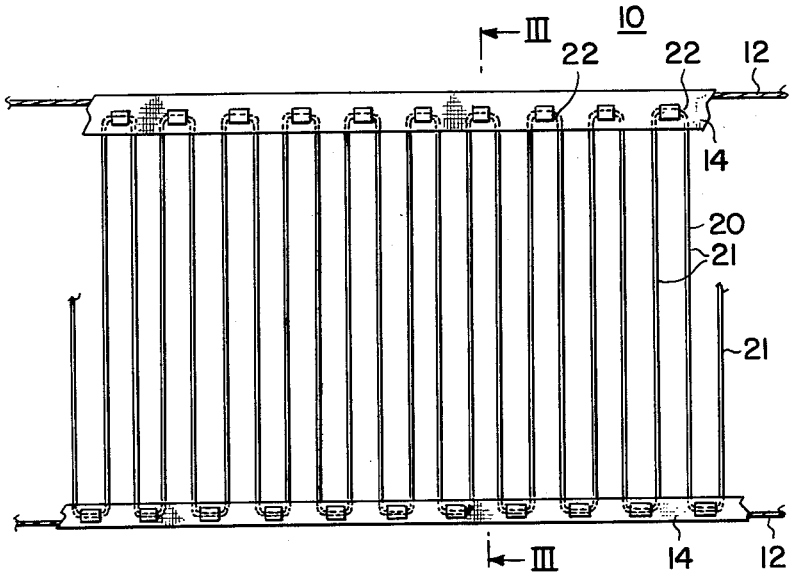
FIG. 2 is a detail elevation view of the invention.
Figure 3:
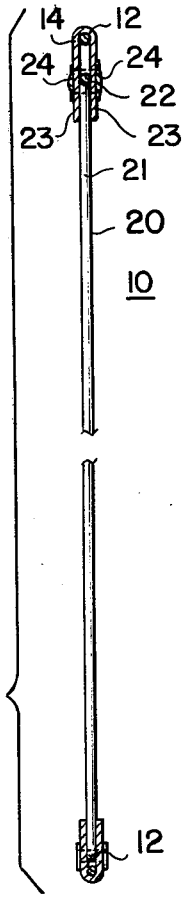
FIG. 3 is a sectional view of the invention, taken along line III—III of FIG. 2.
Figure 4:
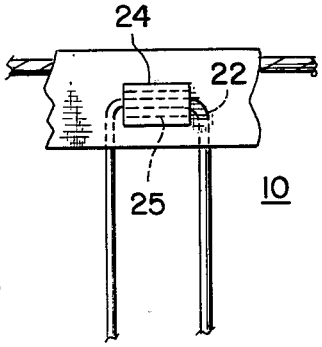
FIG. 4 is a detail front view of the invention.

Turning now descriptively to the drawings, in which similar reference characters denote similar elements throughout the several views, FIGS. 1–4 illustrate the improved tennis net 10, which is supported on a tennis court in conventional fashion by a pair of vertical posts 11 spaced at opposing sides of the court. Net 10 may be formed in any desired combination of external dimensions, but preferably the net 10 is of the size of conventional nets employed for this purpose on regulation size courts.

The net 10 is suspended by a pair of spaced horizontal flexible cables 12 with each cable 12 covered by a fabric strip 41 of U-shaped cross-section that extends the length of the cable 12. Flexible tie straps 15 are fitted to the opposed ends of each strip 14 for fastening the net to the vertical posts 11.

A continuous length of elastic flexible cord 20 is strung in spaced parallel configuration perpendicular to and between cables 12, with cord 20 formed as a series of vertical leg sections 21 joined at each upper and lower end by U-shaped loop sections 22 that is fixed between the two skirts 23 of fabric strip 14 that wrap about a cable 12.

A reinforcement strip 24 is mounted externally each skirt 23 of fabric strip 14 adjacent a loop section 22 enclosed by skirts 23. Stitching 25 through both strips 24 and skirts 23 serves to fix the said loop section 22 in place, but permitting some sliding motion relative to skirts 23, for adjustment purposes of loop section 22 and cord 20 in the area bounded by the stitching 25.

Leg sections 21 of cord 20 are of uniform length and spaced apart by a distance somewhat less than the diameter of a conventional tennis ball.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A tennis net for use on a conventional lawn tennis court comprising a pair of horizontally extending, vertically spaced, upper and lower suspension members, and a plurality of horizontally spaced, vertically extending, elastic members, each said vertical member being a section of a continuous elastic cord;

each suspension member being formed of a flexible cable enclosed by a fabric sleeve of U-shaped configuration, the legs of said U-shaped sleeve of said upper suspension member being turned downwards while the legs of said U-shaped sleeve of said lower suspension member are turned upwards;

means connecting the legs of each U-shaped sleeve in substantially equally spaced locations along the length of said suspension members, said continuous elastic cord being attached between means of said upper and lower U-shaped sleeves to form said plurality of horizontally spaced, vertically extending, elastic members;

the elasticity of said vertical members and the spacing therebetween being functional to cause loss of Kinetic Energy of a conventional tennis ball striking the net but allowing the ball to pass through the net when said suspension members are attached to support posts of a conventional tennis court arrangement.

2. The tennis net of claim 1 wherein each vertically extending elastic member of the elastic cord is fixed in sliding relation to said spaced connecting means.

* * * * *